US010570900B2

(12) United States Patent
Chen et al.

(10) Patent No.: US 10,570,900 B2
(45) Date of Patent: Feb. 25, 2020

(54) OIL SEPARATION BARREL, SCREW COMPRESSOR AND AIR CONDITIONING UNIT

(71) Applicants: Gree Electric Appliances, Inc. of Zhuhai, Guangdong (CN); Gree Electric Appliances Technology Co., Ltd. of Zhuhai, Guangdong (CN)

(72) Inventors: Wenqing Chen, Guangdong (CN); Tianyi Zhang, Guangdong (CN); Rihua Li, Guangdong (CN); Hua Liu, Guangdong (CN); Qiaoming Yang, Guangdong (CN); Shuru Lin, Guangdong (CN); Yushi Bi, Guangdong (CN); Yanhai Peng, Guangdong (CN); Kang Xu, Guangdong (CN); Ziwen Xing, Guangdong (CN)

(73) Assignees: Gree Electric Appliances, Inc. of Zhuhai, Guangdong (CN); Gree Electric Appliances Technology Co., Ltd. of Zhuhai, Guangdong (CN)

( * ) Notice: Subject to any disclaimer, the term of this patent is extended or adjusted under 35 U.S.C. 154(b) by 102 days.

(21) Appl. No.: 15/576,086

(22) PCT Filed: Jul. 6, 2016

(86) PCT No.: PCT/CN2016/088868

§ 371 (c)(1),
(2) Date: Nov. 21, 2017

(87) PCT Pub. No.: WO2017/016377

PCT Pub. Date: Feb. 2, 2017

(65) Prior Publication Data

US 2018/0142689 A1 May 24, 2018

(30) Foreign Application Priority Data

Jul. 27, 2015 (CN) ..... 2015 1 0452264

(51) Int. Cl.
*F01C 1/18* (2006.01)
*F03C 2/00* (2006.01)
(Continued)

(52) U.S. Cl.
CPC ..... *F04C 29/026* (2013.01); *F04C 29/0092* (2013.01); *F04C 29/02* (2013.01);
(Continued)

(58) Field of Classification Search
CPC .... F04C 29/02; F04C 29/0092; F04C 29/026; F04C 29/028; F04C 18/16; F04C 2/16; F25B 1/047
(Continued)

(56) References Cited

U.S. PATENT DOCUMENTS 3,105,630 A 10/1963 Löwler et al.
5,616,013 A 4/1997 Kobayashi et al.
(Continued)

FOREIGN PATENT DOCUMENTS

CN 1140239 A 1/1997
CN 1434215 A 8/2003
(Continued)

OTHER PUBLICATIONS

CN102235362A—Tang et al.—Jacketed wall constructed oil separation cylinder—Nov. 9, 2011—English Translation (Year: 2011).*

*Primary Examiner* — Theresa Trieu
(74) *Attorney, Agent, or Firm* — The Webb Law Firm

(57) ABSTRACT

Disclosed is an oil separation barrel, which includes a barrel body and an oil separation and filtration structure provided in the barrel body, the barrel body provided with an oil separation cavity and an output port. An output gas flow is filtered by the oil separation and filtration structure, then enters the oil separation cavity, and finally is output from the output port. At least part of a barrel wall of the barrel body
(Continued)

forming the oil separation cavity includes two or more layers of circumferential walls. The output gas flow flows in the oil separation cavity in such a manner that it changes the advance direction multiple times, which can make the flow field uniform and reduce noise and vibration; and the output gas flow impacts the circumferential wall surfaces in the oil separation barrel multiple times, which can further improve the efficiency of oil separation.

10 Claims, 8 Drawing Sheets

(51) Int. Cl.

| | |
|---|---|
| ***F03C 4/00*** | (2006.01) |
| ***F04C 18/00*** | (2006.01) |
| ***F04C 29/02*** | (2006.01) |
| ***F25B 1/047*** | (2006.01) |
| ***F04C 29/00*** | (2006.01) |
| *F04C 18/16* | (2006.01) |

(52) U.S. Cl.
CPC ..... *F04C 29/028* (2013.01); *F25B 1/047* (2013.01); *F04C 18/16* (2013.01)

(58) Field of Classification Search
USPC ..... 418/201.1, 270, DIG. 1; 55/315, 318, 55/441, 488
See application file for complete search history.

(56) References Cited

U.S. PATENT DOCUMENTS

| | | | | | |
|---|---|---|---|---|---|
| 5,888,053 | A | | 3/1999 | Kobayashi et al. | |
| 6,009,846 | A | * | 1/2000 | Walker, Jr. | F02M 35/024 123/198 E |
| 6,149,408 | A | * | 11/2000 | Holt | B01D 2239/069 55/488 |
| 6,475,255 | B1 | * | 11/2002 | Walker, Jr. | B01D 50/002 55/315 |
| 7,029,243 | B2 | | 4/2006 | Ono | |
| 2001/0036417 | A1 | * | 11/2001 | Hioki | F04C 18/16 418/201.1 |
| 2012/0174615 | A1 | * | 7/2012 | Cho | F25B 31/004 62/468 |
| 2017/0276137 | A1 | * | 9/2017 | Yang | F04C 18/16 418/201.1 |

FOREIGN PATENT DOCUMENTS

| | | | | | |
|---|---|---|---|---|---|
| CN | 101354041 | A | | 1/2009 | |
| CN | 102235362 | A | | 11/2011 | |
| CN | 202746152 | U | | 2/2013 | |
| CN | 203614417 | U | | 5/2014 | |
| CN | 203685582 | U | | 7/2014 | |
| CN | 203796524 | U | | 8/2014 | |
| CN | 104963872 | A | | 10/2015 | |
| CN | 204851649 | U | | 12/2015 | |
| EP | 0949420 | A1 | | 10/1999 | |
| JP | 55025529 | A | * | 2/1980 | F04C 29/026 |
| JP | 02149789 | A | * | 6/1990 | F04C 29/026 |
| JP | 200460516 | A | | 2/2004 | |
| WO | 2014198359 | A1 | | 12/2014 | |

* cited by examiner

OIL SEPARATION BARREL, SCREW COMPRESSOR AND AIR CONDITIONING UNIT

CROSS-REFERENCE TO RELATED APPLICATIONS

This application is the United States national phase of International Application No. PCT/CN2016/088868 filed Jul. 6, 2016, and claims priority to Chinese Patent Application No. 201510452264.5 filed Jul. 27, 2015, the disclosures of which are hereby incorporated in their entirety by reference.

BACKGROUND OF THE INVENTION

Field of the Invention

The present application relates to the field of compressors, and especially relates to an oil separation barrel, a screw compressor and an air conditioning unit.

Description of Related Art

As an important component of a semi-hermetic screw compressor, the oil separation barrel plays a role of guiding the refrigerant to be output from the compressor, disposing such oil separation structures as an oil separation and filtration screen, providing an oil tank and so on. Generally, an oil separation barrel with a single wall is used in existing semi-hermetic screw compressors. An output pipe is located at the upper or lower end inside the oil separation barrel according to the position of the spool valve. The refrigerant gas passes through the oil separation and filtration screen to separate refrigeration oil carried by the gas and then is output from the compressor through a stop valve.

FIG. 1 shows an exemplary embodiment of a compressor in the prior art. In this embodiment, the oil separation barrel 1' is a structure with a single wall and is provided therein with an oil separation and filtration screen 2'. In this structure, only the oil separation and filtration screen 2' can play a role of oil separation. The refrigerant gas output through an output pipe 3' passes through the oil separation and filtration screen 2 and then is output out of the compressor through an output stop valve 4'. Since the output pipe 3' is located at the upper end inside the oil separation barrel 1', the output gas can hardly pass through the oil separation and filtration screen 2' uniformly, which will affect the efficiency of the oil separation and filtration screen 2' to a certain extent. Therefore, the oil separation part provided in this embodiment cannot achieve high efficiency of oil separation.

FIG. 2 shows an exemplary embodiment of another compressor in the prior art. In this embodiment, in order to improve the efficiency of oil separation, the oil separation barrel 1' is provided therein with a cyclone separation structure 5' which can not only play a role of direct oil separation, but also increase the uniformity of the gas flow field and thus indirectly improve the efficiency of oil separation. The cyclone separation structure 5' provided in the oil separation barrel 1' increases the depth of the oil separation barrel and the axial dimension of the compressor, which does not apply to the situation where the compressor is required to be miniaturized and increases the manufacturing cost.

To sum up, existing screw compressors having an oil separation barrel with a single wall are liable to have such problems as nonuniform output gas flow and not high oil separation efficiency, or that an increased cyclone separation structure causes excessively long machine body and increases costs.

SUMMARY OF THE INVENTION

An object of the present application is to provide an oil separation barrel, a screw compressor and an air conditioning unit, which can improve the uniformity of the gas flow field and the efficiency of oil separation.

In order to achieve the above-mentioned object, the present application provides an oil separation barrel, which comprises a barrel body and an oil separation and filtration structure in the barrel body, the barrel body being provided with an oil separation cavity and an output port. An output gas flow is filtered by the oil separation and filtration structure, then enters the oil separation cavity, and is output from the output port. At least part of a barrel wall of the barrel body forming the oil separation cavity comprises two or more layers of circumferential walls.

In one embodiment, the barrel wall comprises an outer circumferential wall enclosing the oil separation cavity and an inner circumferential wall separating the oil separation cavity into an inner oil separation cavity and an outer oil separation cavity.

In one embodiment, the inner circumferential wall is provided with a connection port communicating the inner oil separation cavity with the outer oil separation cavity. After being filtered by the oil separation and filtration structure, the output gas flow flows into the inner oil separation cavity and then enters the outer oil separation cavity through the connection port.

In one embodiment, at least one the connection port is provided symmetrically with respect to the output port.

In one embodiment, the outer oil separation cavity is an annular cavity for forming circular motion of the output gas flow around the axis of the oil separation barrel in the outer oil separation cavity.

In one embodiment, the output port is provided on the circumferential wall and positioned in the circumferential middle of the outer oil separation cavity.

In one embodiment, the outer oil separation cavity encloses at least a half of the inner oil separation cavity in the circumferential direction.

In one embodiment, the barrel wall comprises an outer circumferential wall enclosing the oil separation cavity, an inner circumferential wall and an intermediate wall positioned between the inner circumferential wall and outer circumferential wall, and the inner circumferential wall and the intermediate circumferential wall separate the oil separation cavity into an inner cavity, an intermediate cavity and an outer cavity. The three cavities are in communication successively in a way such that an output gas flow enters the intermediate cavity through the inner cavity, then enters the outer cavity through the intermediate cavity and is finally output from the output port disposed on the outer circumferential wall.

In order to achieve the above-mentioned object, the present application also provides a screw compressor comprising an oil separation barrel described in any one of the above embodiments.

In order to achieve the above-mentioned object, the present application further provides an air conditioning unit comprising a screw compressor described in any one of the above embodiments.

Based on the above technical solution, the present application at least has the following advantageous effects:

The oil separation barrel provided by the present application comprises an oil separation cavity, at least part of the barrel wall forming the oil separation cavity having two or more layers of circumferential walls. The output gas flow flows in the oil separation cavity of the barrel body having two or more circumferential walls in such a manner that it changes the advance direction multiple times, which can make the flow field uniform, improve oil separation efficiency and reduces noise and vibration; and the output gas flow impacts the circumferential wall surfaces in the oil separation barrel multiple times, which can further improve the efficiency of oil separation.

BRIEF DESCRIPTION OF THE ACCOMPANYING DRAWINGS

The drawings illustrated here are for providing further understanding of the present application and thus constitute part of the present application. The exemplary embodiments of the present application and descriptions thereof are for interpreting the present application, not constituting improper limitations of the present application. In the drawings.

REFERENCE SIGNS IN THE DRAWINGS

1'—oil separation barrel; 2'—oil separation and filtration screen; 3'—output pipe; 4'—output stop valve; 5'—cyclone separation structure; 1—inner oil separation cavity; 2—outer oil separation cavity; 3—oil separation and filtration structure; 4—output port; 5—connection port; 6—inner circumferential wall; 7—outer circumferential wall; 8—inner cavity; 9—intermediate cavity; 10—outer cavity; 11—first connection port; 12—second connection port.

DETAILED DESCRIPTION OF THE PREFERRED EMBODIMENTS

Hereinafter, clear and complete description of the technical solutions in the embodiments will be made in combination with the drawings in the embodiments of the present application. Obviously, the embodiments described are only a part of rather than all of the embodiments of the present application. All other embodiments obtained by persons of ordinary skill in the art based on the embodiments of the present application without creative efforts shall fall within the protection scope of the present application.

In the description of the present application, it should be understood that, the orientations or positional relationships indicated by such terms as "center", "longitudinal" "transverse", "front", "rear", "vertical", "horizontal", "top", "bottom", "inner", "outer" are orientations or positional relationships based on the drawings, and they are only for the purpose of facilitating describing the present application and simplifying the description, instead of indicating or suggesting that the described device or element must have a specific orientation and must be configured and operated in a specific orientation, so that they cannot be construed as limiting the protection scope of the present application.

Figure 1:
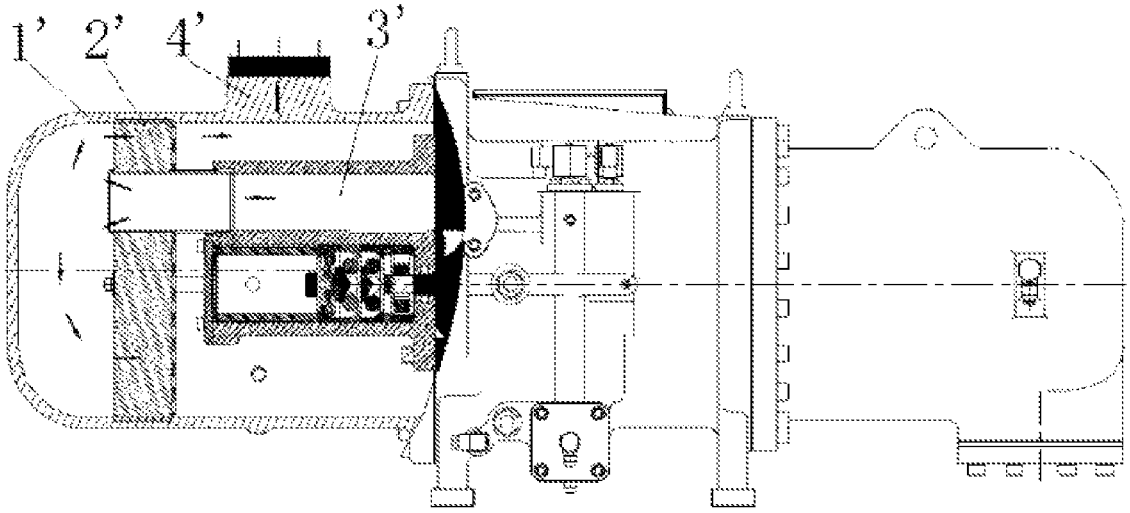
Prior Art Fig. 1
FIG. 1 is a schematic view of the structure of a compressor in the prior art.
Figure 2:
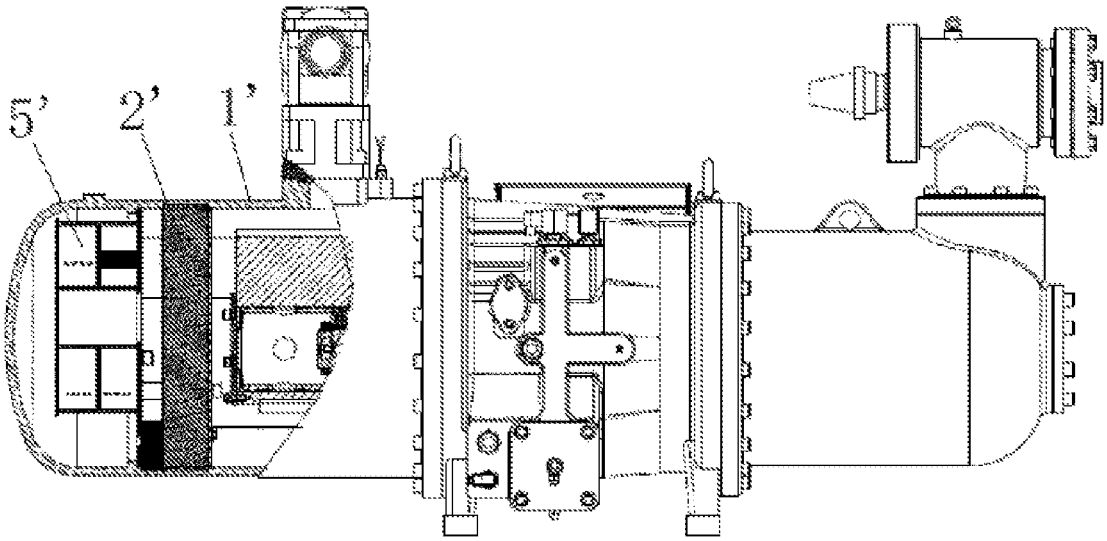
Prior Art Fig. 2
FIG. 2 is a schematic view of the structure of another compressor in the prior art.
Figure 3:
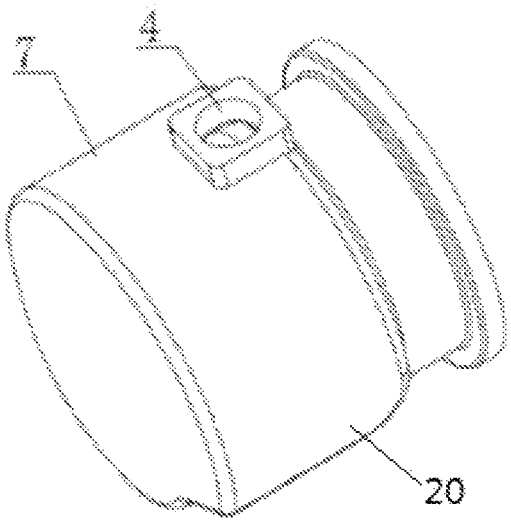
FIG. 3 is a schematic view of the external structure of an oil separation barrel provided in one embodiment of the present application.
Figure 4:
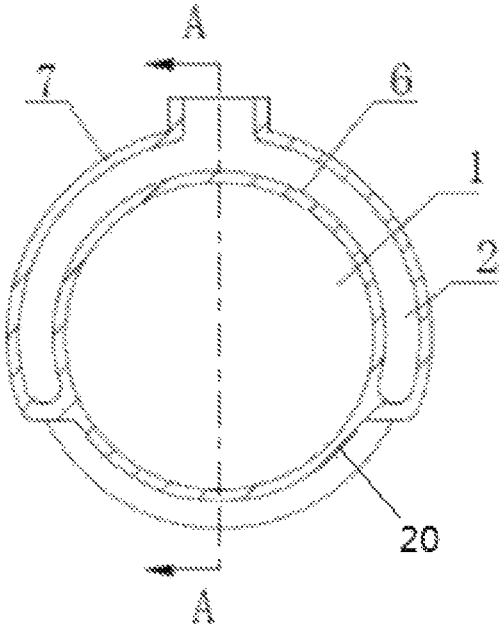
FIG. 4 is a schematic sectional view of the oil separation barrel shown in FIG. 3 in the radial direction.
Figure 5:
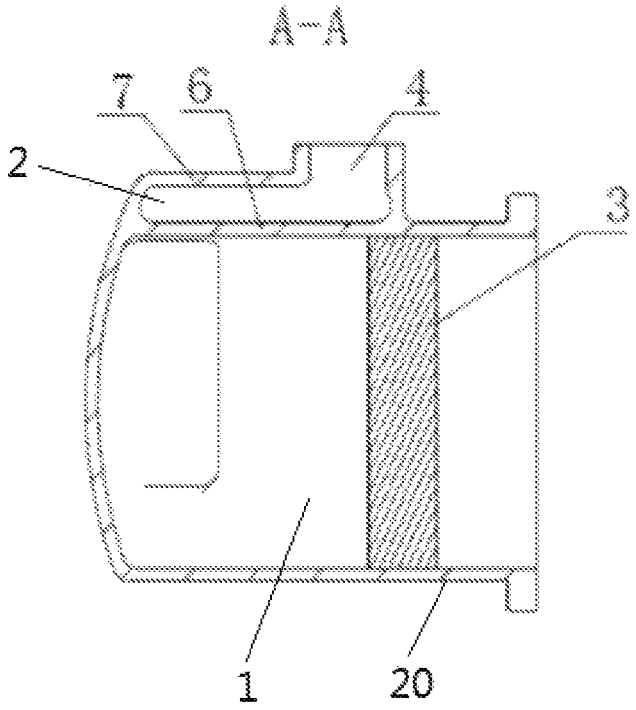
FIG. 5 is a schematic sectional view of FIG. 4 in the A-A direction.

FIG. 3 is a schematic view of the appearance of one embodiment of the oil separation barrel provided by the present application. FIG. 4 is a schematic sectional view of the oil separation barrel shown in FIG. 3 in the radial direction. FIG. 5 is a schematic sectional view of FIG. 4 in the A-A direction. As shown in FIGS. 3, 4, and 5, in the embodiment, the oil separation barrel comprises a barrel body 20 and an oil separation and filtration structure 3 provided in the barrel body 20, and the barrel body 20 is provided with an oil separation cavity and an output port 4. An output gas flow is filtered by the oil separation and filtration structure 3, then enters the oil separation cavity, and finally is output from the output port 4. In the present application, at least part of a barrel wall of the barrel body 20 forming the oil separation chamber has two or more layers of circumferential walls. Before being output from the output port 4, the output gas flow flows in the oil separation cavity in the barrel body 20 having two or more layers of circumferential walls in such a manner that it changes the advance direction multiple times, which can make the flow field uniform and improve the efficiency of oil separation; and the output gas flow impacts the circumferential wall surfaces in the oil separation barrel multiple times, which can further improve the efficiency of oil separation. In addition, such structure can also reduce noise and vibration.

Figure 9:
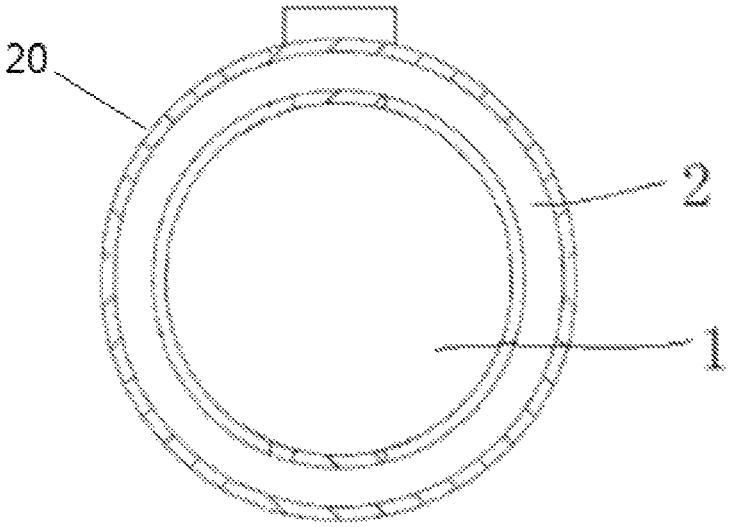
FIG. 9 is a schematic view of another embodiment of the present application, in which the outer oil separation cavity provided encloses the entire inner oil separation cavity.
Figure 10:
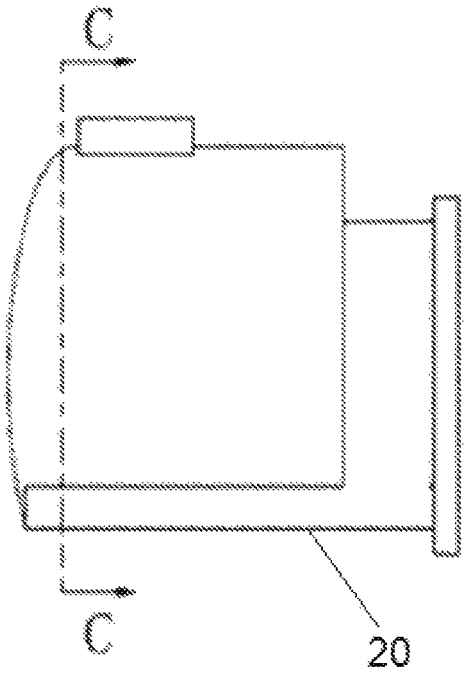
FIG. 10 is a schematic view of the external structure of an oil separation barrel provided in another embodiment of the present application.

As shown in FIG. 4, the barrel wall may include an inner circumferential wall 6 and an outer circumferential wall 7 enclosing the oil separation cavity, and the inner circumferential wall 6 separating the oil separation cavity into an inner oil separation cavity 1 and an outer oil separation cavity 2. According to the present application, the outer oil separation cavity 2 may enclose at least a half of the inner oil separation cavity 1 in the circumferential direction, or the outer oil separation cavity 2 may also enclose the entire inner oil separation cavity 1 (as in another embodiment shown in FIG. 9) or enclose at least one third of the inner oil separation cavity 1 in the circumferential direction (not shown).

In terms of vibration and noise reduction, compared with the single-wall structure of the oil separation barrel in the prior art, the oil separation barrel provided by the prevent application has a barrel wall with double circumferential walls, which can better shield the noise at the output end of the compressor and damp vibration. The vibration and noise are first transmitted from the inner oil separation cavity 1 to the inner circumferential wall 6, and then the inner circumferential wall 6 radiates the vibration and noise to the outer oil separation cavity 2, and in this process noise and vibration are somewhat reduced. The vibration and noise in the outer oil separation cavity 2 are then transmitted to the outer circumferential wall 7, and finally the vibration and noise radiated from the outer circumferential wall 7 are further reduced. In this way, the double wall has one more wall surface for damping vibration and shielding noise than the single wall, which can significantly reduce the vibration and noise.

Figure 6:
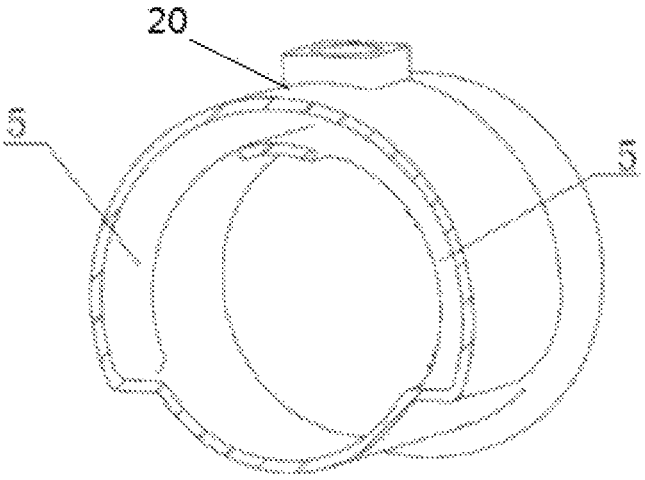
FIG. 6 is a schematic view of a structure in which a connection port is provided in the inner oil separation cavity in the embodiment shown in FIGS. 3-5.

FIG. 5 is a schematic sectional view of FIG. 4 in the A-A direction. An oil separation and filtration structure 3 is provided in the inner oil separation cavity 1. An output port 4 is provided on the outer circumferential wall outside the oil separation cavity 2. The tail portion of the inner oil separation cavity 1 is provided with a connection port 5 communicating with the outer oil separation cavity 2 (as shown in FIG. 6). After being filtered by the oil separation and filtration structure 3, the output gas flow can flow to the tail portion of the inner oil separation cavity 1, enter the outer oil separation cavity 2 through the connection port 5 and finally be output through the output port 4.

In the above embodiment, the output gas flow output from the output chamber of the output bearing seat in the compressor enters the oil separation barrel and then passes through the oil separation and filtration structure 3 in the oil separation barrel to filter the liquid drops contained in the gas flow and then flows to the tail portion of the inner oil separation cavity 1. During this process the flow field can be made the flow field uniform, noise and vibration can be reduced. Then when the output gas flow passes through the connection port 5, the flow direction suddenly changes, and oil drops in the output gas flow will impact the wall surface of the oil separation barrel under the effect of inertia, producing an effect of separation by impact. After the output airflow enters the outer oil separation cavity 2 through the connection port 5, it is possible to further achieve the effect of making the flow field uniform and reducing noise and vibration. Finally, the output gas flows converge and are output out of the compressor from the output port 4, which can significantly improve the efficiency of oil separation.

Figure 8:
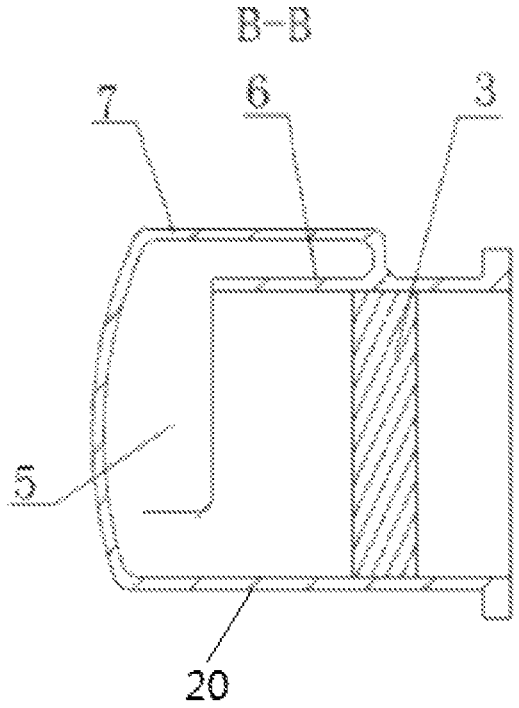
FIG. 8 is a schematic sectional view of FIG. 7 in the B-B direction.

As shown in FIG. 4 or 8, the outer oil separation cavity 2 may be a partially annular cavity or an annular cavity, which can form the partially circular motion or circular motion of the output gas flow around the axis of the oil separation barrel in the outer oil separation cavity 2. In the outer oil separation cavity 2, the gas flow flows towards the output port 4 along the wall surface of the outer oil separation cavity 2. Since the shape of the outer oil separation cavity 2 is a narrow ring, which forms the partially circular motion or circular motion of the gas flow around the axis of the oil separation barrel in the outer oil separation cavity 2, a centrifugal action produced by such motion further separates the oil drops in the output gas flow.

To sum up, the oil separation barrel having two or more layers walls provided by the present application improves oil separation efficiency from three aspects: centrifugal separation, separation by impact and uniform flow field; and it plays a role of damping vibration and reducing noise by means of multiple layers of shielding structure.

Figure 7:
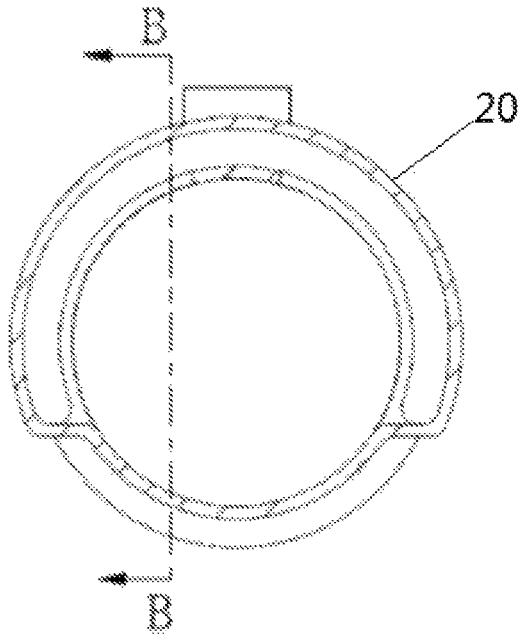
FIG. 7 is a front view of FIG. 6.

In one embodiment, the output port 4 may be positioned in the circumferential middle of the outer oil separation cavity 2. As shown in FIGS. 6, 7 and 8, the connection port 5 is provided on the inner circumferential wall 6 of the oil separation barrel. At least one connection port 5 is provided, which may be symmetrical with respect to the output port 4. For example, two connection ports 5 are provided in FIG. 6, and the two connection ports 5 are symmetrical with respect to the output port 4. Those in the art should know that actual configuration is not limited to two connection ports 5.

In the oil separation barrel with a single wall in the prior art, the gas flow enters the oil separation barrel and then tends to flow towards the output port at the top, resulting in concentration of flow velocity around the output port. Thus, the flow field is not uniform, which affects the efficiency of the separation and filtration structure. In the oil separation barrel with a structure of two or more walls provided by the present application, the output gas flow enters the inner oil separation cavity 1 and then flows to the connection port 5 symmetrically disposed at the tail portion. Movement in this process basically remains in the axial direction, such that the flow field is more uniform, which improves the efficiency of the oil separation and filtration structure. Moreover, the gas flow flows to the output port 4 through the connection port 5 disposed symmetrically with respect to the output port 4, which makes the flow field in the outer oil separation cavity 2 more uniform and further improves the efficiency of oil separation.

Further, the radial structure of the oil separation barrel may also be completely symmetrical, which can improve the uniformity of the flow field and the oil separation efficiency.

In the above embodiment, an oil separation and filtration screen or the like may be used for the oil separation and filtration structure 3.

In the above embodiment in which the oil separation barrel has a structure including an inner circumferential wall and an outer circumferential wall, an inner oil separation cavity and an outer oil separation cavity are formed. This structure can make the flow field in the oil separation cavity more uniform and improve the oil separation efficiency. The connection port between the inner and outer oil separation cavities provided in this structure can produce impact effect of flow field to separate the oil drops. This structure can also produce the centrifugal action of the outer oil separation cavity to separate the oil drops. Therefore, the oil separation efficiency of the compressor is improved from at least three aspects. In addition, due to the increased shielding of the outer circumferential wall, the oil separation barrel provided by the present application can also play a role of vibration and noise reduction.

Figure 11:
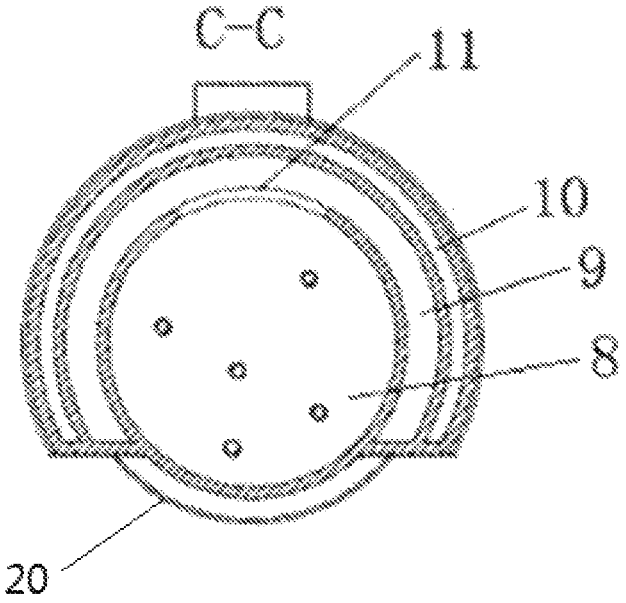
FIG. 11 is a schematic sectional view of FIG. 10 in the C-C direction.
Figure 12:
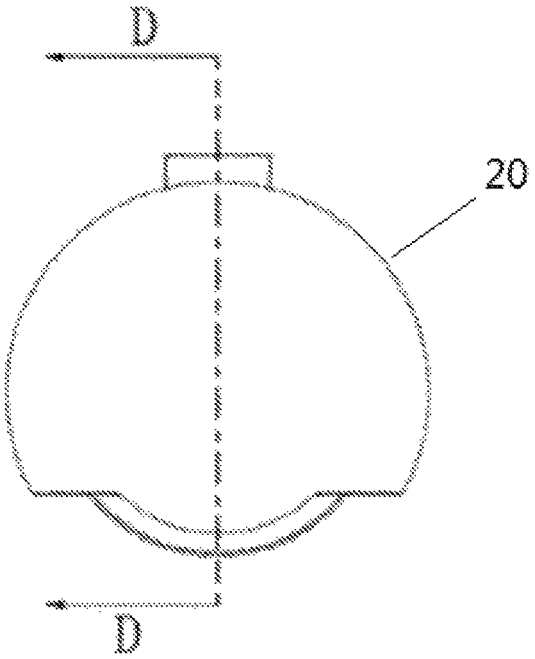
FIG. 12 is a side view of FIG. 10.

FIGS. 10-15 shows an oil separation barrel of another embodiment provided by the present application. In this embodiment, a barrel wall of the barrel body 20 of the oil separation barrel may be provided with three circumferential walls: an outer circumferential wall enclosing the oil separation cavity, an inner circumferential wall and an intermediate circumferential wall between the inner circumferential wall and the outer circumferential wall. The inner circumferential wall and the intermediate circumferential wall separate the oil separation cavity into three cavities: an inner cavity 8, an intermediate cavity 9 and an outer cavity 10 (as shown in FIG. 11). The three cavities are in communication successively in a way such that the output gas flow enters the intermediate cavity 9 through the inner cavity 8, then enters the outer cavity 10 through the intermediate cavity 9 and finally is output from the output port 4 disposed on the outer circumferential wall. Before being output from the output port 4, the output gas flow flows in the oil separation barrel having three circumferential walls in such a manner that it changes the advance direction multiple times, which can make the flow field uniform and improve oil separation efficiency. The output gas flow impacts the circumferential wall surfaces in the oil separation barrel multiple times, which can further improve the efficiency of oil separation and reduce noise and vibration.

Figure 13:
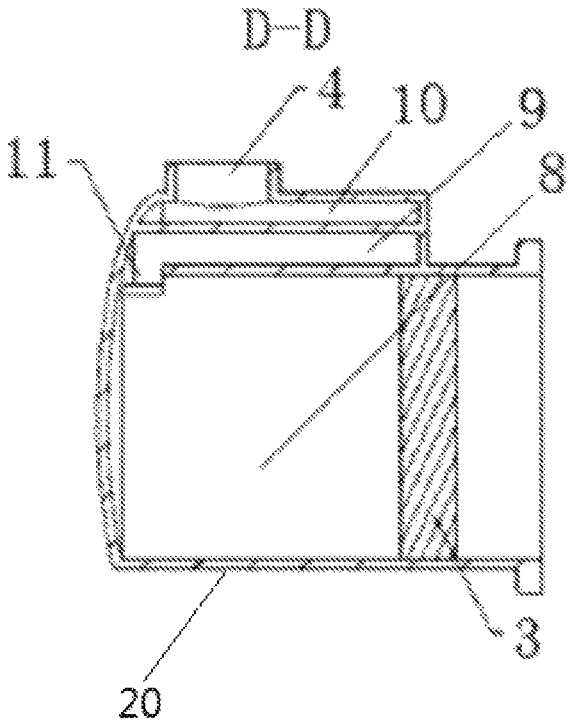
FIG. 13 is a schematic sectional view of FIG. 12 in the D-D direction.
Figure 14:
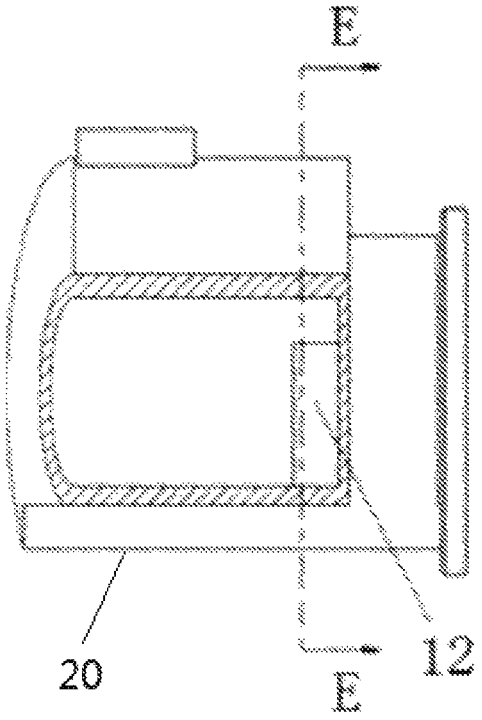
FIG. 14 is a schematic sectional view of a part of FIG. 10.
Figure 15:
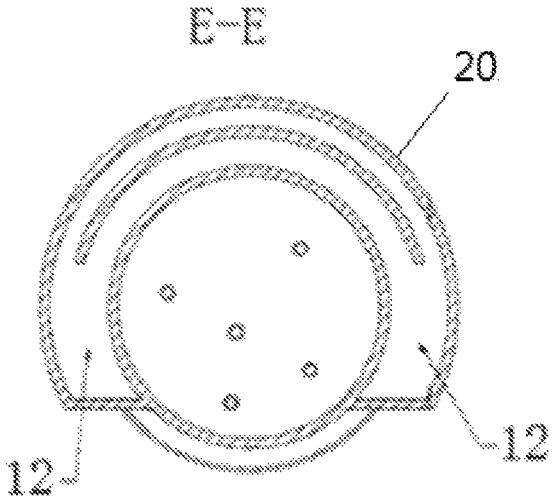
FIG. 15 is a schematic sectional view of FIG. 14 in the E-E direction.

In one embodiment, the connection port between the inner cavity 8 and the intermediate cavity 9 is a first connection port 11 which may be provided in the upper middle of the tail portion of the inner circumferential wall (the left side in FIGS. 10 and 13) (as shown in FIG. 11). The connection port between the intermediate cavity 9 and the outer cavity 10 is a second connection port 12 which may be provided in the lower part of the front portion of the intermediate circumferential wall (the right side in FIGS. 10 and 14). Further, two connection ports 12 may be provided (as shown in FIG. 15), which are symmetrical with respect to the first connection port 11 (as shown in FIG. 13). The arrangement of the first connection port 11 and the second connection port 12 is not limited to the above-described positions.

In the above embodiment, the refrigerant gas of the inner cavity 8 passes through the oil separation and filtration structure 3 and then enters the intermediate cavity 9 through the first connection port 11 in the upper part of the tail portion of the inner cavity 8. At this time, the flow direction of the refrigerant gas changes by 180°. In the inner cavity 8, the refrigerant gas flows from the right to the left (right and left in FIG. 10), while in the intermediate cavity 9, the gas flow flows from the left to the right (right and left in FIG. 10). The change in flow direction helps to improve the oil separation efficiency.

The flow of the refrigerant in the intermediate cavity 9 is from the first connection port 11 in the upper part of the tail portion to the second connection port 12 in the lower part of the front portion, with a certain circular motion. After entering the outer cavity 10 from the second connection port 12 in the lower part of the front portion, the gas is output out of the compressor from the output port 4 in the upper part of the tail portion of the outer cavity 10. There is another great change in the direction of the gas flow during this process, and a certain circular motion is present in the outer cavity 10. The flow with multiple changes in the direction can make the flow field uniform and improve the efficiency of oil separation. The output gas flow impacts the inner circumferential wall surface of the oil separation barrel multiple times, which can further improve the efficiency of oil separation and reduce noise and vibration.

The "tail portion" in the above embodiment refers to the position away from the oil separation and filtration structure 3 in FIG. 13 (the left side in FIG. 13), and the "front portion" refers to the position near the oil separation and filtration structure 3 in FIG. 13 (the right side in FIG. 13).

The present application also provides a screw compressor comprising an oil separation barrel described in any one of the above embodiments and an output bearing seat covered by the oil separation barrel.

The screw compressor provided by the present application can be applied on an air conditioning unit.

The air conditioning unit provided by the present application comprises the above-mentioned screw compressor in which an oil separation barrel provided by the present application is disposed. Therefore, both the air conditioning unit and the screw compressor correspondingly have the advantageous effects of the oil separation barrel provided by the present application.

Finally, it should be noted that: the above-mentioned embodiments are only used for explaining the technical solutions of the present application instead of limiting the same; while the present application has been described in detail with reference to the preferred embodiments, those skilled in the art should understand that: modifications can still be made to the embodiments of the present application, or equivalent replacement can be made to part of the technical features thereof; and these modifications or replacement, not departing from the spirit of the technical solutions of the present application, should all be contained in the scope of the technical solutions defined in the present application.

The invention claimed is:

1. An oil separation barrel, comprising:

a barrel body; and an oil separation and filtration structure provided in the barrel body, the barrel body being provided with an oil separation cavity and an output port, such that an output gas flow enters in the oil separation barrel, is filtered by the oil separation and filtration structure, enters the oil separation cavity, and is output from the output port;

wherein at least part of a barrel wall of the barrel body forming the oil separation cavity comprises two or more layers of circumferential walls, such that before being output from the output port, the output gas flow flows in the oil separation cavity in such a manner that a flowing direction of the output gas flow changes multiple times.

2. The oil separation barrel according to claim 1, wherein the barrel body comprising:

an outer circumferential wall enclosing the oil separation cavity; and an inner circumferential wall, the inner circumferential wall separating the oil separation cavity into an inner oil separation cavity and an outer oil separation cavity.

3. The oil separation barrel according to claim 2, wherein the inner circumferential wall is provided with a connection port communicating the inner oil separation cavity with the outer oil separation cavity, such that after being filtered by the oil separation and filtration structure, the output gas flow flows into the inner oil separation cavity and then enters the outer oil separation cavity through the connection port.

4. The oil separation barrel according to claim 3, wherein at least one the connection port is provided symmetrically with respect to the output port.

5. The oil separation barrel according to claim 2, wherein the outer oil separation cavity is an annular cavity for forming circumferential movement of the output gas flow around the axis of the oil separation barrel in the outer oil separation cavity.

6. The oil separation barrel according to claim 2, wherein the output port is provided on the outer circumferential wall and positioned in the circumferential middle of the outer oil separation cavity.

7. The oil separation barrel according to claim 2, wherein the outer oil separation cavity encloses at least a half of the inner oil separation cavity in the circumferential direction.

8. The oil separation barrel according to claim 1, wherein the barrel wall comprising:

an outer circumferential wall enclosing the oil separation cavity;

an inner circumferential wall; and an intermediate circumferential wall positioned between the outer circumferential wall and the inner circumferential wall; and wherein the inner circumferential wall and intermediate wall separate the oil separation cavity into an inner cavity, an intermediate cavity and an outer cavity, and the three cavities are in communication successively in a way such that an output gas flow enters the intermediate cavity through the inner cavity, then enters the outer cavity through the intermediate cavity and is finally output from the output port disposed on the outer circumferential wall.

9. A screw compressor, wherein comprising an oil separation barrel according to claim 1.

10. An air conditioning unit, comprising a screw compressor according to claim 9.

* * * * *